US009805926B2

(12) United States Patent
Schönfelder et al.

(10) Patent No.: US 9,805,926 B2
(45) Date of Patent: Oct. 31, 2017

(54) VIBRATION RESISTANT AUTOMOTIVE FRONT LIGHTING LAMP

(71) Applicant: KONINKLIJKE PHILIPS N.V., Eindhoven (NL)

(72) Inventors: Bernd Schönfelder, Eindhoven (NL); Gerd-Peter Dohlen, Eindhoven (NL); Johannes Gerhard Möller, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 85 days.

(21) Appl. No.: 14/917,906

(22) PCT Filed: Sep. 3, 2014

(86) PCT No.: PCT/EP2014/068720
§ 371 (c)(1),
(2) Date: Mar. 9, 2016

(87) PCT Pub. No.: WO2015/036300
PCT Pub. Date: Mar. 19, 2015

(65) Prior Publication Data

US 2016/0225605 A1 Aug. 4, 2016

(30) Foreign Application Priority Data

Sep. 13, 2013 (EP) ..... 13184366

(51) Int. Cl.
*H01K 1/00* (2006.01)
*H01K 1/18* (2006.01)
(Continued)

(52) U.S. Cl.
CPC ..... *H01K 1/18* (2013.01); *F21S 48/1109* (2013.01); *F21S 48/1172* (2013.01); *H01K 1/28* (2013.01);
(Continued)

(58) Field of Classification Search
CPC .. H01K 1/18; H01K 3/20; H01K 3/06; H01K 9/08; H01K 1/28; F21S 48/1172; F21S 48/1109
See application file for complete search history.

(56) References Cited

U.S. PATENT DOCUMENTS 3,469,140 A 9/1969 Bottone et al.
3,646,386 A * 2/1972 Rijnders ..... H01K 9/08 313/115
3,774,064 A * 11/1973 Vause ..... H01K 1/66 313/273

FOREIGN PATENT DOCUMENTS

DE 102005046204 A1 3/2007
DE 102007025074 A1 12/2008
(Continued)

OTHER PUBLICATIONS

EPO as ISA, PCT/EP2014/08720, filed Sep. 3, 2014, "International Search Report and Written Opinion" dated Oct. 13, 2014, 10 pages.
(Continued)

*Primary Examiner* — Donald Raleigh

(57) ABSTRACT

A lamp for automotive front lighting and a vehicle headlight comprising the lamp are described, as well as a method of manufacturing the lamp. The lamp 10 comprises a base 12 for mechanical and electrical connection to an automotive headlight 50. A burner 14 is fixed to the base 12 and comprises an enclosed transparent vessel 22. A first filament 34 is arranged within the vessel 22. A holding wire 30*c* is arranged within the vessel, and a baffle 40 is arranged proximate to the first filament 34 to partially shield light emitted from the first filament 34. The baffle 40 is fixed to the holding wire 30*c*. The transparent vessel 22 comprises a vessel wall including a cylindrical portion 24 surrounding the first filament 34. In order to obtain a lamp which may withstand vibration, the vessel wall comprises, within the
(Continued)

cylindrical portion 24, a deformed material portion 38 which contacts the baffle 40 or the holding wire 30*c*. The deformed material portion 38 is shielded from the first filament 34 by the baffle 40. During manufacture, the first filament 34, the baffle 40 and the holding wire 30*c* are inserted into the vessel 22, and the vessel wall is deformed to provide the deformed material portion 38.

12 Claims, 3 Drawing Sheets

(51) Int. Cl.

| | |
|---|---|
| ***H01K 1/28*** | (2006.01) |
| ***H01K 9/08*** | (2006.01) |
| ***F21S 8/10*** | (2006.01) |
| ***H01K 3/06*** | (2006.01) |
| ***H01K 3/20*** | (2006.01) |

(52) U.S. Cl.
CPC ..... *H01K 3/06* (2013.01); *H01K 3/20* (2013.01); *H01K 9/08* (2013.01)

(56) References Cited

FOREIGN PATENT DOCUMENTS

| | | | | | |
|---|---|---|---|---|---|
| DE | 102008015557 | A1 | | 9/2009 | |
| EP | 0817243 | A2 | | 1/1998 | |
| FR | 2347776 | | * | 4/1976 | ..... H01K 1/26 |

OTHER PUBLICATIONS

Extended European Search Report dated Jan. 8, 2014 from European Patent Application No. 13184366.6.

* cited by examiner

VIBRATION RESISTANT AUTOMOTIVE FRONT LIGHTING LAMP

CROSS-REFERENCE TO RELATED APPLICATIONS

The present application is a §371 application of International Application No. PCT/EP2014/068720 filed on Sep. 3, 2014 and entitled "Vibration Resistant Automotive Front Lighting Lamp," which claims priority to European Patent Application No. 13184366.6, filed Sep. 13, 2013. Both PCT/EP2014/068720 and EP13184366.6 are incorporated herein.

FIELD OF THE INVENTION

The invention relates to an electrical lamp, and in particular to a lamp for use in automotive vehicle front lighting, and to a method of manufacturing such a lamp. The invention further relates to a vehicle headlight.

BACKGROUND OF THE INVENTION

Automotive headlights, i.e. headlights for use on board of a vehicle, such as e.g. a car, motorcycle, truck or other type of vehicle generally comprise a reflector and, mounted therein, a lamp. Known incandescent lamps, in particular halogen lamps, generally comprise a base and a burner. The base provides mechanical and electrical connection to the automotive headlight, whereas the burner comprises the actual light-emitting element, in particular filament. Light emitted from the filament is reflected by the reflector to form a beam for illumination in front of the vehicle.

Different types of incandescent lamps are known, which comprise one or more filaments arranged within a vessel.

DE 10 2007 025 074 A1 describes an incandescent lamp, in particular for use in a headlight of a motor vehicle. Within an enclosed lamp bulb out of quartz glass, lighting elements are arranged between current delivering wires. A baffle partially shields one of the lighting elements. The baffle is tub-shaped and welded at its rear to one of the current delivering wires. The baffle may further be supported by a supporting wire connected with the tip of the bulb. In order to improve vibration resistance, the wall of the lamp bulb is deformed close to a holding bar to form a ring-shaped bulge clamping the holding bar. Further, lugs are formed at the interior of the lamp bulb to clamp the baffle from both sides.

It is an object to propose a lamp well suited for use on board of vehicles under different operating conditions.

SUMMARY OF THE INVENTION

According to an aspect of the invention, a lamp according to claim 1, a vehicle headlight according to claim 9 and a manufacturing method according to claim 10 are proposed. Dependent claims refer to preferred embodiments.

Different attempts have been made to obtain an automotive lamp, i.e. a lamp for use on board of a vehicle which is resistant to vibration. In particular for use on board of a motorcycle, lamps may be required that withstand strong vibration of several g. The present inventors have recognized that a lamp with a special vibration-resistant construction may still be easy to manufacture and maintain advantageous optical properties.

A lamp according to an aspect of the invention comprises a base for mechanical and electrical connection to an automotive headlight. Electrical contacts may protrude out of the base, in particular from the rear thereof. The base further preferably comprises a positioning ring which serves for mounting the lamp in a reflector of a vehicle headlight in a defined position and orientation. The positioning ring may comprise radial protrusions, which may serve for mechanical fixing, and for exact positioning. It is in particular preferred to provide one reference protrusion to define a radial reference direction R.

The lamp further comprises a burner with a sealed vessel, at least partially transparent, preferably of quartz glass. According to the invention, at least a first filament is arranged within the vessel. In preferred embodiments, a second filament may be arranged within the vessel, provided at a distance from the first filament. Preferably, the filaments are spaced along the longitudinal axis of the lamp, i.e. the axis extending centrally through the positioning ring.

According to one aspect, a baffle is arranged proximate to a first filament. As will become apparent in connection with preferred embodiments, the baffle may in particular be arranged to cover the axial range of the first filament, i.e. be arranged in radial directions of the first filament along the whole axial length thereof. Thus, a portion of the light emitted from the first filament, emitted into spatial directions of the proximate baffle, will be shaded by the baffle.

At least one holding wire is arranged within the vessel. In preferred embodiments, two or three holding wires are provided. The holding wires may be fixed in a pinch seal of the vessel, and may project into its interior. One of the holding wires may serve to hold the baffle in its position proximate to the first filament. The baffle is fixed to the holding wire, preferably welded thereto. Further, the first and second filaments may be fixed to the holding wires.

According to an aspect of the invention, the transparent vessel comprises a vessel wall which includes a cylindrical portion surrounding at least the first filament. According to an aspect of the invention, a deformed material portion is provided within the cylindrical portion of the vessel wall, where the otherwise cylindrical shape of the material of the vessel wall is deformed and may project into the interior of the otherwise cylindrical vessel. According to an aspect of the invention, the deformed material portion at least contacts the baffle or the holding wire to which the baffle is fixed. This stabilizes the baffle and/or holding wire and therefore limits movement thereof in response to vibration.

The contact may in principle be one-sided, i.e. such that the baffle and/or the holding wire simply lie adjacent to the deformed material portion of the vessel wall. Already this type of contact may serve to render the lamp more resistant to vibration. Preferably, the contact between the deformed material portion and the baffle/holding wire is an adhering contact, such that even under the application of an external force by vibration, the baffle/holding wire will not separate from the deformed material portion of the vessel wall. In particular, it is preferred that the deformed material portion at least partially encloses the holding wire and/or the portion of the baffle to obtain a form-fitting contact securely anchoring the baffle and/or holding wire within the deformed material portion.

According to one aspect, the deformed material portion is arranged at a position where it is shielded from the first filament by the baffle. In particular, it is preferred that the baffle may include an inner side (facing the first filament) and an opposite outer side, and that the deformed material portion is arranged to contact the outer side, and/or the holding wire arranged at the outer side.

By thus arranging the deformed material portion in a shaded position, in particular on the outer side of the baffle, optical distortion caused by the deformed material portion is minimized.

Embodiments of the invention have in tests been shown to withstand mechanical shocks of up to 10 g. Optical distortion due to the deformed material portion, which may e.g. be formed as a dimple of the material of the vessel wall, in particular quartz glass, is minimal if the deformed portion is arranged behind the baffle, as viewed from the first filament.

Still, the lamp is easy to manufacture and existing manufacturing processes may easily be modified to provide the deformed portion. In the manufacturing method according to the invention, it is preferred to provide the transparent vessel with the cylindrical portion of the vessel wall without the deformed portion, and to insert the baffle and holding wire before closing the vessel. After the baffle and holding wire (and preferably also all further elements to be placed into the interior of the vessel, such as filaments, further holding wires etc.), and before or preferably after closing the vessel, e.g. by pinch seal, the vessel wall may be deformed at the cylindrical portion to provide the deformed material portion at a position shielded from the first filament by the baffle. In particular, this may be done by heating the vessel wall at least up to a softening temperature, at least locally at the position of the deformed material portion to be formed. The deformation may be formed by gas pressure.

According to one embodiment, the holding wire may comprise a free end, projecting from the fixing position of the holding wire to the baffle. This free end is well suited for contact between the deformed material portion and the holding wire. Preferably, the deformed material portion at least partially encloses the free end of the holding wire to establish a form-fitting fixation.

In one embodiment with at least a second filament, it is preferred that the deformed material portion is arranged at a position which is shielded not only from the first filament but also from the second filament by the baffle. This positioning may in particular be obtained by arranging the deformed material portion at a free projecting end of the holding wire. The deformed material portion is then arranged shaded from direct light by both filaments, such that optical distortion is further minimized.

According to a preferred embodiment of the invention, at least three holding wires are arranged to project into the interior of the vessel. The first filament, preferably also a second filament and the baffle are fixed to the holding wires. A pinch seal is formed at a portion of the vessel, sealing the vessel and embedding the holding wires. Thus, the holding wires extend from the pinch seal into the interior of the vessel. Further, a holding bar is arranged within the interior of the vessel, distant from the pinch seal. The holding bar serves to hold the holding wires, preferably by at least partially enclosing the wires within the material of the holding bar. The holding bar is preferably made out of glass. Regarding the manufacturing method, it is preferred to form the holding bar before inserting the holding wires into the vessel.

According to one embodiment, the base comprises three electrical contacts, and three holding wires are arranged extending from a pinch seal into the interior of the vessel. Each of the holding wires is electrically connected to one of the electrical contacts. The first filament is electrically connected between a first and a third holding wire, and the second filament is electrically connected between a second and the third holding wire. Thus, the filaments share a common electrical connection. Preferably, the first filament is not connected directly to the third holding wire, but electrical contact is established via the baffle fixed to the third holding wire.

In preferred embodiments, the baffle may be of concave shape, e.g. provided in one piece and made out of correspondingly shaped sheet metal, in particular molybdenum. A front surface of the baffle may be arranged at a front axial end of the baffle, preferably the end facing towards the base, arranged at least partially in between the filaments. Thus, the baffle may be effective to shield the second filament from light emitted from the first filament. The baffle thus serves to separate angular ranges illuminated by both filaments from angular ranges illuminated only by the second filament, where light emitted from the first filament is shaded at the baffle. Corresponding portions of the reflector may be shaped to reflect light emitted from the first filament—which may be denoted a low beam filament—into a first beam (low beam, comprising a bright/dark cutoff) and correspondingly reflect light emitted from the second filament (e.g. high-beam filament) into a reflected beam (high beam) without a bright/dark cutoff.

According to one preferred embodiment, the filaments and the baffle may be shaped and arranged symmetrically within the vessel relative to a symmetry plane. In a preferred embodiment, the symmetry plane may be defined by the longitudinal axis X of the lamps and by a radial reference direction R defined by a reference protrusion of the base. By shaping and arranging the optical elements, i.e. the filaments and the baffle symmetrical to this reference plane, the resulting intensity distribution after reflection at the reflector of a vehicle headlight will also be symmetrical, i.e. comprise a horizontally arranged bright/dark cutoff.

According to a further aspect, a vehicle headlight with a reflector may be equipped with a lamp according to one of the above aspects. In particular, the vehicle headlamp may be a motorcycle headlamp.

These and other aspects of the invention will become apparent from and elucidated with reference to the embodiment described hereinafter.

DETAILED DESCRIPTION OF EMBODIMENTS

Figure 1:
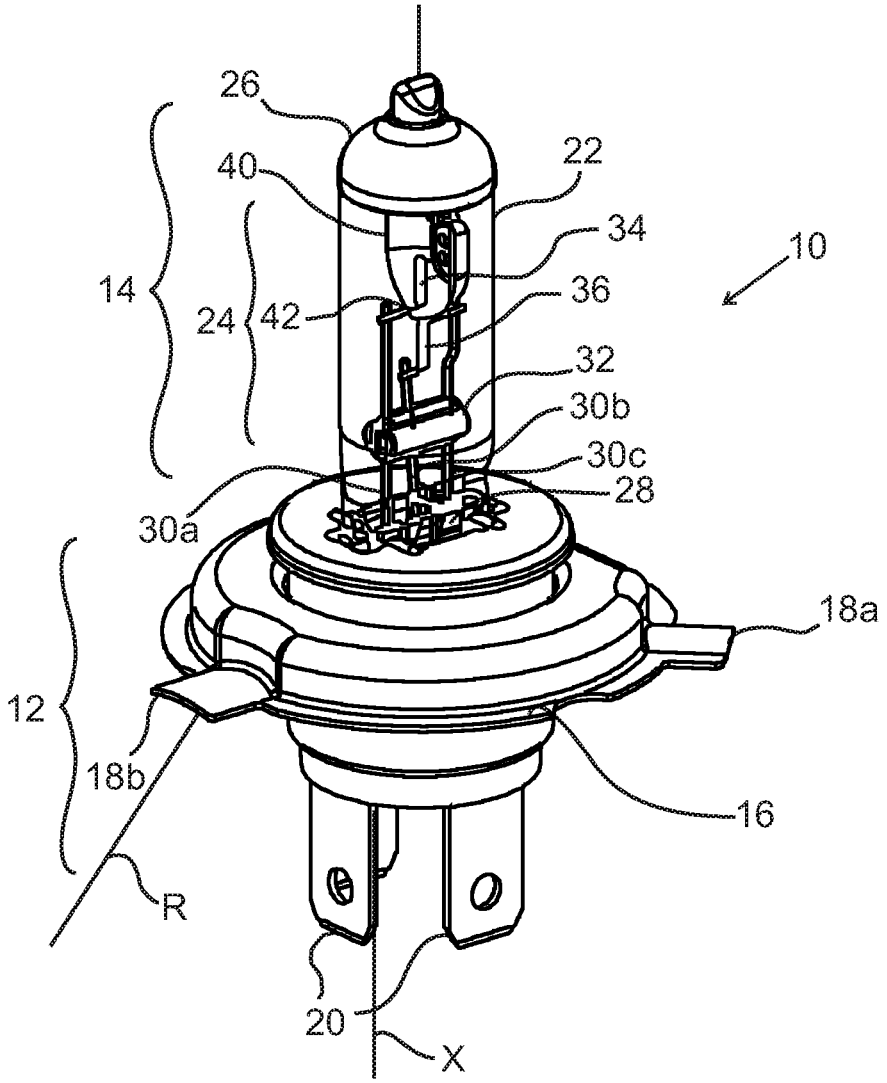
FIG. 1 shows a perspective view of a lamp according to a first embodiment of the invention.
Figure 2:
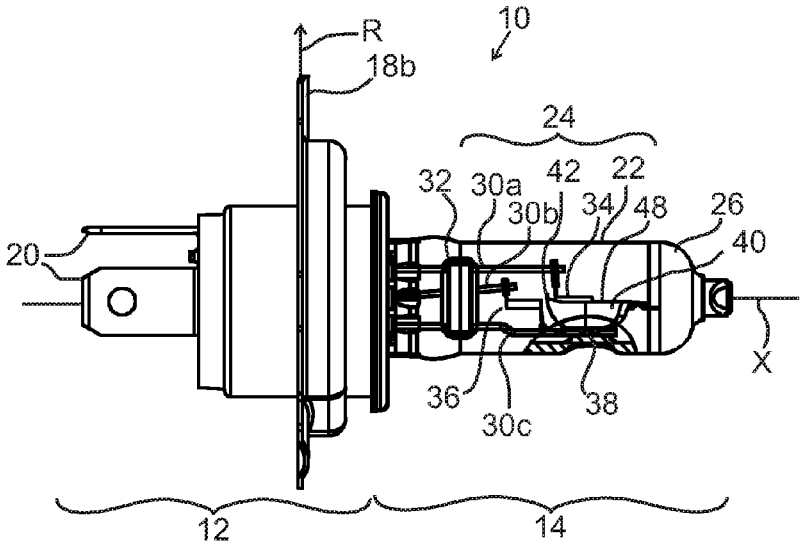
FIG. 2 shows a side view of the lamp of FIG. 1 in the horizontal operating position.

FIGS. 1, 2 show an automotive halogen lamp 10.

The lamp 10 comprises a base 12 and a burner 14 fixed to the base 12.

The base 12 comprises a positioning ring 16 which includes three positioning protrusions 18*a*, 18*b* radially protruding from the base 12 (of which only two are shown in FIG. 1). A reference plane for positioning is defined by the upper portions of the protrusions 18*a*, 18*b*, 18*c*.

Figure 4:
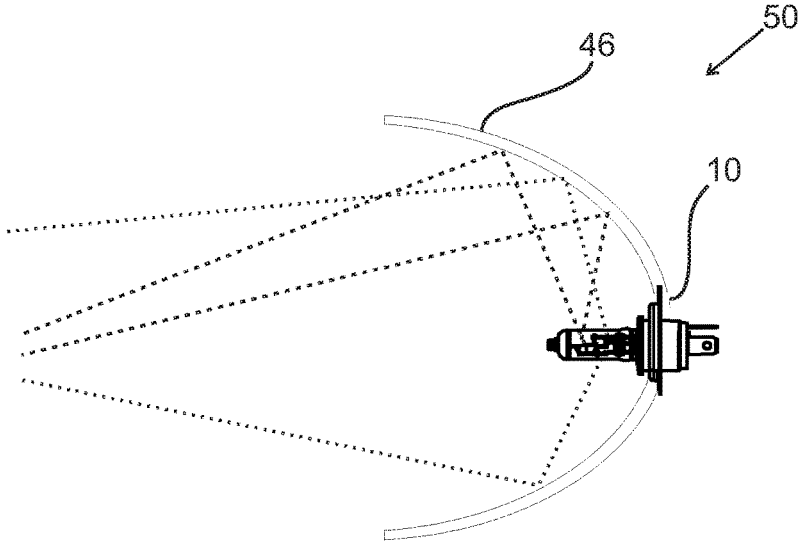
FIG. 4 shows in a schematic representation a vehicle headlight with a lamp according to FIGS. 1-3.

The lamp 10 may be fixed to a vehicle headlight so as symbolically shown in FIG. 4 at the protrusions 18*a*, 18*b*.

The protrusion 18*b* serves as a reference protrusion defining a radial reference direction R. A symmetry plane is positioned to include a longitudinal axis X of the lamp 10, extending centrally through the positioning ring 16 perpendicular to the reference plane, and the radial reference direction R extending radially from the longitudinal axis X into the direction of the reference protrusion 18*b*.

The burner 14 comprises a quartz glass vessel 22 with a central portion 24 of generally circular cylindrical shape (except for a deformation as will be described below). At the top, the otherwise transparent vessel 22 comprises a coated portion 26 which is opaque. At the bottom, the vessel 22 is sealed in a pinch seal 28, which is fixed to the base 12.

Projecting from the pinch seal 28 into the interior of the vessel 22 are three holding wires 30*a*, 30*b*, 30*c*. The holding wires 30*a*, 30*b*, 30*c* are further fixed by a holding bar 32 made out of quartz glass material and arranged distant from the pinch seal 28. The holding wires 30*a*-30*c* are embedded within the material of the holding bar 32. Further, fixed to the holding wires 30*a*, 30*b*, 30*c* are arranged a first filament 34 (low-beam filament) and a second filament 36 (high-beam filament).

Proximate to the first filament 34, a baffle 40 is arranged, welded to a third of the holding wires (30*c*). As shown, the baffle is provided to cover the axial extent of the first filament 34 and thus partially shield light emitted from the filament 34 into radial directions. Further, a front portion 42 of the baffle 40 is arranged in between the first and second filaments 34, 36 and therefore serves to shield the filaments 34, 36 from one another.

Figure 3A:
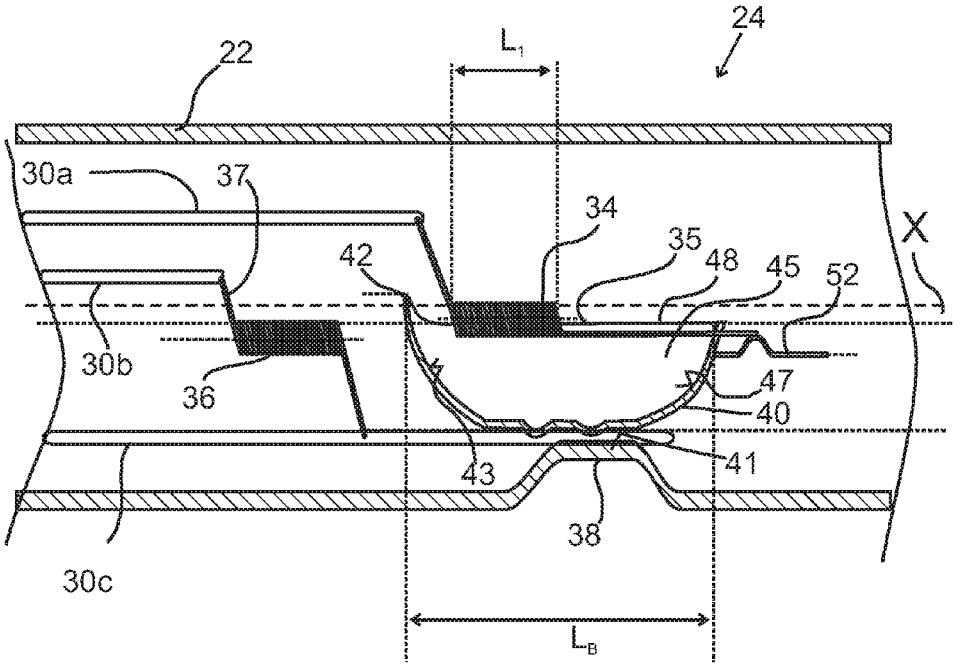
FIG. 3*a* shows an enlarged sectional view of a portion of the lamp of FIG. 1 with the section taken along line R in FIG. 1.

As also shown in detail in the enlarged sectional view of FIG. 3*a*, the first, low beam filament 34 is connected at one end to a first holding wire 30*a* and at the other end to the baffle 40, which is welded to the third holding wire 30*c*. The second, high-beam filament 36 is fixed to a second holding wire 30*b* and to the third holding wire 30*c*. By these connections, the filaments 34, 36 are both mechanically held at defined positions within the vessel 22 and are electrically connected between the holding wires 30*a*, 30*b*, 30*c*. The holding wires, in turn, are connected internally within the base 12 to electrical contacts 20 protruding from the lower portion of the base 12. Thus, the filaments 34, 36 may be operated by supplying electrical power at the electrical contacts 20.

FIG. 3*a* shows an enlarged sectional view of the central, circular-cylindrical portion 24 of the vessel 22. As shown, the filaments 34, 36 are each provided as a single winding structure of filament wire wound around a straight filament axis.

In FIG. 3, the filament axis 35 of the first filament 34 and the filament axis 37 of the second filament 36 are arranged in parallel to the longitudinal axis X of the lamp 10.

The baffle 40 comprises a bottom surface 41 from which a front surface 43, a back surface 47, and side surfaces 45 extend. The side surfaces 45 terminate in side edges 48. At the back surface 47, an attachment tab 52 is integrally formed.

The attachment tab 52 serves to connect the filament wire of the first filament 34 to the baffle 40. It is arranged substantially flat in a plane that is oriented horizontally in FIG. 3. As shown, the filament wire of the first filament 34 is welded to the attachment tab 52.

As shown in FIG. 2, FIG. 3*a*, the wall of the vessel 22 is deformed at a position located in the horizontal arrangement of FIG. 2, FIG. 3*a* below the baffle 40. A deformed material portion, or dimple 38 is formed in the wall of the vessel 22 to contact and partially enclose the third holding wire 30*c*. The dimple 38 may also contact the lower surface 41 of the baffle 40. The baffle 40 and the holding wire 30*c* are therefore mechanically held by the wall of the vessel 22, such that movement thereof relative to the vessel 22 is limited even under the application of forces of inertia due to vibration.

During manufacture of the lamp 10, first the vessel 22 is formed without the pinch seal 28, i.e. open to the left in FIG. 2, FIG. 3. The holding wires 30*a*-30*c* with attached filaments 34, 36 and the baffle 40, connected together by the holding bar 32 are inserted into the interior of the vessel 22. By forming the pinch seal 28, the holding wires 30*a*-30*c* are embedded into the quartz glass material.

In a further step, the deformation 38 is formed by heating the wall of the vessel at least locally to a softening temperature and impressing the dimple 38 such that the softened quartz glass material contacts the third holding wire 30*c* and at least partially encloses parts thereof, such that the holding wire 30*c* and the baffle 40 adhere to the deformation 38 thus obtained.

In particular, the deformation 38 may be formed by gas pressure, namely by applying a vacuum at the tip of the lamp 10, such that atmospheric pressure at the exterior of the vessel 22 will form the dimple 38 at the locally heated position of the wall.

In a further step, the interior of the vessel 22 is filled with a suitable filling for a halogen lamp with a filling gas of halogen and xenon and crypton as rare gas filling before the vessel 22 is closed off at the tip. The gas filling is provided such that the lamp at room temperature has a cold filling pressure of 1 Mpa.

The position of the deformation 38 is chosen to be shielded from the first filament 34 by the baffle 40, i.e. the deformation 38 is located behind the baffle 40 as viewed from the first filament. Correspondingly, the optical distortion caused by the deformation 38 is minimal, because light emitted from the first filament 34 is shaded at the baffle 40 and does not directly reach the position of the deformation 38, whereas only a very small portion of light emitted from the second filament 36 passes through the wall of the vessel 22 at the position of the deformation 38.

Figure 3B:
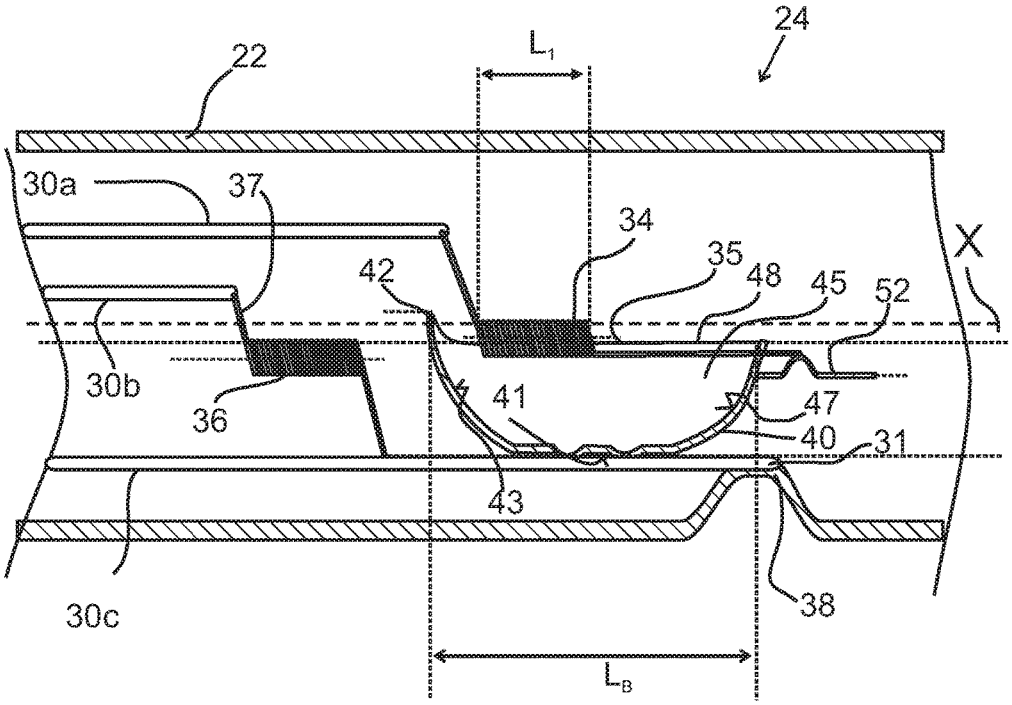
FIG. 3*b* shows an enlarged sectional view of a portion of a second embodiment of a lamp.

FIG. 3*b* shows an alternative embodiment in a view similar to FIG. 3*a*. The alternative embodiment largely corresponds to the previously described first embodiment, thus only differences will be explained.

In the alternative embodiment, the holding wire 30*c* is provided longer such that a free end 31 projects from the point of contact to the baffle 40. The dimple 38 is formed at a position closer to the tip of the lamp, and encloses the free end 31 of the holding wire 30*c*.

The alternative position of the dimple 38 as shown in FIG. 3*b* further has the advantage that the dimple 38 is shielded not only from direct light emitted from the first filament 34, but also from direct light emitted from the second filament 36. Thus, in the alternative embodiment optical distortion is further minimized.

As shown in FIG. 3*a*, 3*b*, the axial length $L_1$ of the first filament 34 entirely overlaps with the axial length $L_B$ of the baffle 40. Thus, a substantial portion of light emitted from the first filament 34 is shielded at the side edges 48 of the baffle 40, leading to a corresponding straight bright/dark cutoff.

FIG. 4 shows schematically a headlight 50 where the lamp 10 as described above is schematically shown arranged within a reflector 46. Light emitted from the filaments 34, 36 (not shown in FIG. 3) is reflected by the reflector 46 to form different illumination beams. Light from the second (high-beam) filament 36 is shown as a dotted line to be reflected by both the upper and lower part of the reflector 46 to form a high-beam without a bright/dark cutoff.

Light emitted from the first low-beam filament 34 is shown as a dashed line to be partially shielded by the baffle 40 such that only an upper portion of the reflector 46 is illuminated. The upper portion of reflector 46 is shaped to reflect the light from the first filament 34 to form an illumination beam with a horizontal bright/dark cutoff. In the resulting low beam, there is no distortion from the deformation 38, because of the position thereof behind the baffle 40.

Arrangement of the filaments 34, 36 and of the baffle 40 is exactly symmetrical with regard to the symmetry plane defined by the axes R, X. Thus, the resulting beam patterns are symmetrical, too. In particular, the low-beam pattern will have a horizontal bright/dark cutoff.

While the invention has been illustrated and described in detail in the drawings and foregoing description, such illustration and description are to be considered illustrative or exemplary and not restrictive; the invention is not limited to the disclosed embodiment.

Variations from the disclosed embodiments can be understood and effected by those skilled in the art in practicing the claimed invention, from a study of the drawings, the disclosure and the appended claims. In the claims the word "comprising" does not exclude other elements, and the indefinite articles "a" or "an" do not exclude a plurality.

The mere fact that certain measures are recited in mutually different dependent claims does not indicate that a combination of these measures cannot be used to advantage. Any reference signs in the claims should not be construed as limiting the scope.

The invention claimed is:

1. Lamp for automotive vehicle front lighting, comprising
a base for mechanical and electrical connection to an automotive headlight,
a burner fixed to said base, said burner comprising a sealed transparent vessel,
at least a first filament arranged within said vessel,
at least one holding wire arranged within said vessel, and a baffle arranged proximate to said first filament to partially shield light emitted from said first filament, said baffle being fixed to said holding wire,
where said transparent vessel comprises a vessel wall including a cylindrical portion surrounding said first filament,
and where said vessel wall comprises, within said cylindrical portion, a deformed material portion which contacts said baffle or said holding wire,
where said deformed material portion is shielded from said first filament by said baffle.

2. Lamp according to claim 1, wherein
said baffle includes an inner side facing said first filament and an outer side arranged opposite to said inner side,
where said deformed material portion is arranged to contact said outer side of said baffle, or said holding wire on said outer side of said baffle.

3. Lamp according to claim 1, wherein
said deformed material portion at least partially encloses said holding wire.

4. Lamp according to claim 1, wherein
said holding wire comprises a free end projecting from a fixing position of said baffle,
wherein said deformed material portion at least partially encloses said free end of said holding wire.

5. Lamp according to claim 1, further comprising
at least a second filament arranged within said vessel.

6. Lamp according to claim 5, wherein
said deformed material portion is shielded from said second filament by said baffle.

7. Lamp according to claim 1, wherein
at least three holding wires are arranged within said vessel, and said filaments and said baffle are fixed to said holding wires,
where said holding wires extend from a pinch seal of said vessel into the interior of said vessel,
and where a holding bar is arranged distant from said pinch seal, said holding bar enclosing said holding wires.

8. Lamp according to claim 1, wherein
said base comprises three electrical contacts,
and three holding wires are arranged extending from a pinch seal of said vessel into the interior of said vessel, each of said holding wires being electrically connected to one of said electrical contacts,
where said first filament is electrically connected between a first and a third holding wire, and where a second filament is electrically connected between a second and said third holding wire.

9. Vehicle headlight, comprising
a reflector,
and a lamp according to claim 1.

10. Method of manufacturing a lamp for automotive vehicle front lighting, said lamp comprising a base for mechanical and electrical connection to an automotive headlight, said method comprising the steps of
providing a transparent vessel comprising a vessel wall including a cylindrical portion,
inserting at least a first filament and a baffle fixed to at least one holding wire into said vessel, such that said first filament is surrounded by said cylindrical portion of said vessel wall,
deforming said vessel wall to provide, within said cylindrical portion, a deformed material portion which contacts said baffle or said holding wire,
where said deformed material portion is formed at a position shielded from said first filament by said baffle.

11. Method according to claim 10, where
said step of deforming said vessel wall includes heating said vessel wall at least to a softening temperature.

12. Method according to claim 10, further comprising
deforming said vessel wall to form a pinch seal embedding said holding wire.

* * * * *